US008608409B2

(12) United States Patent
Collina et al.

(10) Patent No.: US 8,608,409 B2
(45) Date of Patent: Dec. 17, 2013

(54) FOUNDATION PILE DRIVER

(75) Inventors: Vincenzo Collina, Villagrappa (IT); Roberto Zago, Rovereto (IT); Lamberto Zambianchi, Villafranca (IT)

(73) Assignee: So.L.E.S.-Societa' Lavori Edili e Serbatoi S.p.A., Forli (IT)

( * ) Notice: Subject to any disclaimer, the term of this patent is extended or adjusted under 35 U.S.C. 154(b) by 816 days.

(21) Appl. No.: 12/086,989

(22) PCT Filed: Dec. 22, 2006

(86) PCT No.: PCT/EP2006/070165
§ 371 (c)(1),
(2), (4) Date: May 9, 2011

(87) PCT Pub. No.: WO2007/071783
PCT Pub. Date: Jun. 28, 2007

(65) Prior Publication Data

US 2011/0200398 A1 Aug. 18, 2011

(30) Foreign Application Priority Data

Dec. 23, 2005 (IT) ..... BO05A0792

(51) Int. Cl.
*E02D 7/00* (2006.01)

(52) U.S. Cl.
USPC ..... 405/232

(58) Field of Classification Search
USPC ..... 405/229–232, 165, 199; 173/213, 53, 173/58
See application file for complete search history.

(56) References Cited

U.S. PATENT DOCUMENTS

| | | | | | |
|---|---|---|---|---|---|
| 3,763,654 | A * | 10/1973 | Matsushita | 405/232 |
| 3,992,890 | A * | 11/1976 | Pryke | 405/232 |
| 4,405,115 | A * | 9/1983 | Boyadjieff | 254/106 |
| 5,269,630 | A | 12/1993 | Bolin et al. | 405/230 |
| 5,318,386 | A * | 6/1994 | Desprez | 405/196 |
| 5,482,407 | A | 1/1996 | Raaf | 405/230 |
| 6,364,573 | B1 * | 4/2002 | Baugh | 405/166 |
| 6,688,393 | B2 * | 2/2004 | Sredensek et al. | 166/377 |
| 2002/0062622 | A1 | 5/2002 | Bell et al. | 52/741.15 |

FOREIGN PATENT DOCUMENTS

WO WO2005028759 3/2005 ..... E02D 27/48

OTHER PUBLICATIONS

International Search Report and Written Opinion dated Apr. 5, 2007 based on PCT application No. PCT/EP2006/070165.

* cited by examiner

*Primary Examiner* — Frederick L Lagman
*Assistant Examiner* — Kyle Armstrong
(74) *Attorney, Agent, or Firm* — Ohlandt Greeley Ruggiero & Perle L.L.P.

(57) ABSTRACT

A pile driver for driving foundation piles, and having: a frame, in turn having a horizontal base, at least one upright extending upwards from the base, and a movable body which slides along the upright; a first lock device fitted to the horizontal base and which, in use, rigidly engages a connecting member of a foundation structure; a second lock device fitted to the movable body and which, in use, rigidly engages a shaft of a pile to be driven; and at least one hydraulic jack connected to the frame and to the movable body to move the movable body along the upright.

15 Claims, 9 Drawing Sheets

FOUNDATION PILE DRIVER

TECHNICAL FIELD

The present invention relates to a foundation pile driver.

BACKGROUND ART

As described in Patent Application WO2005028759A1, a building foundation structure is known having at least one through hole, and at least two connecting cables extending through and fixed to the structure, adjacent to the hole, and projecting upwards. When the foundation structure is completed, a metal foundation pile is inserted through the hole, is subjected statically to a series of thrusts to drive it into the ground, and, once driven in, the top part of the pile is fixed axially to the foundation structure. Each thrust is applied by a pile driver, which is positioned over the pile, cooperates with the top end of the pile, and is connected to the projecting part of the connecting cables, which, when driving the pile, act as reaction elements for the pile driver.

Alternatively, instead of the connecting cables, each hole in the foundation structure may be lined with a metal guide tube, which is fixed to the foundation structure by at least one ring embedded in the foundation structure, and has a top portion projecting upwards from the foundation structure and to which the pile driver is fixed rigidly.

As described in Patent Application WO2005028759A1, the pile driver is positioned over the pile to be driven, is connected to the projecting portion of the relative guide tube by at least two ties threaded at the top, and comprises at least one hydraulic jack comprising a cylinder and a piston movable axially with adjustable force with respect to the cylinder. The cylinder is placed on the top end of the pile, and the piston is brought into contact with the bottom surface of a reaction plate bolted integrally to the ties by respective bolts engaging the threaded top portions of the ties.

Once the pile driver is connected to the pile as described above, the hydraulic jack of the pile driver is activated to generate a force of given intensity between the jack cylinder and piston, and so subject the pile statically to a thrust, of the same intensity as the force, to drive the pile into the ground. The reaction force to the thrust exerted by the pile driver is provided by the weight of the foundation structure, and is transmitted by the ties, which, together with the guide tube, act as reaction elements, by maintaining the distance between the reaction plate and the foundation structure fixed as the piston comes out of the cylinder, thus driving the cylinder, and the top end of the pile with it, downwards.

The shaft of the pile driven into the ground is normally divided into a number of segments, which are driven successively, as described above, through the hole in the foundation structure, and are welded to one another. Once one shaft segment is driven, the pile driver is disconnected from the top end of the segment to insert another segment, which is butt welded to the driven segment; the pile driver is then connected to the top end of the next segment, and the driving cycle is continued.

The pile driver described above has several drawbacks: it takes a relatively long time to set up; it fails to provide for high driving force (over 75 tons); and it must be removed to join the driven shaft segment to the next segment.

U.S. Pat. No. 5,269,630A1 discloses an apparatus for lifting and stabilizing a structural slab overlying the ground including a base attached to the upper surface of the slab, at least one hydraulic cylinder vertically supported from the base, and a slip clamp assembly attached to the piston rod extending from the cylinder. Piling segments are sequentially passed downward through the slip clamp and through coaxial holes in the base and in the slab, and are driven into the ground by the hydraulic cylinder to form a support column under the slab.

DISCLOSURE OF INVENTION

It is an object of the present invention to provide a foundation pile driver designed to eliminate the aforementioned drawbacks, and which, at the same time, is cheap and easy to implement.

According to the present invention, there is provided a foundation pile driver as claimed in the accompanying Claims.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
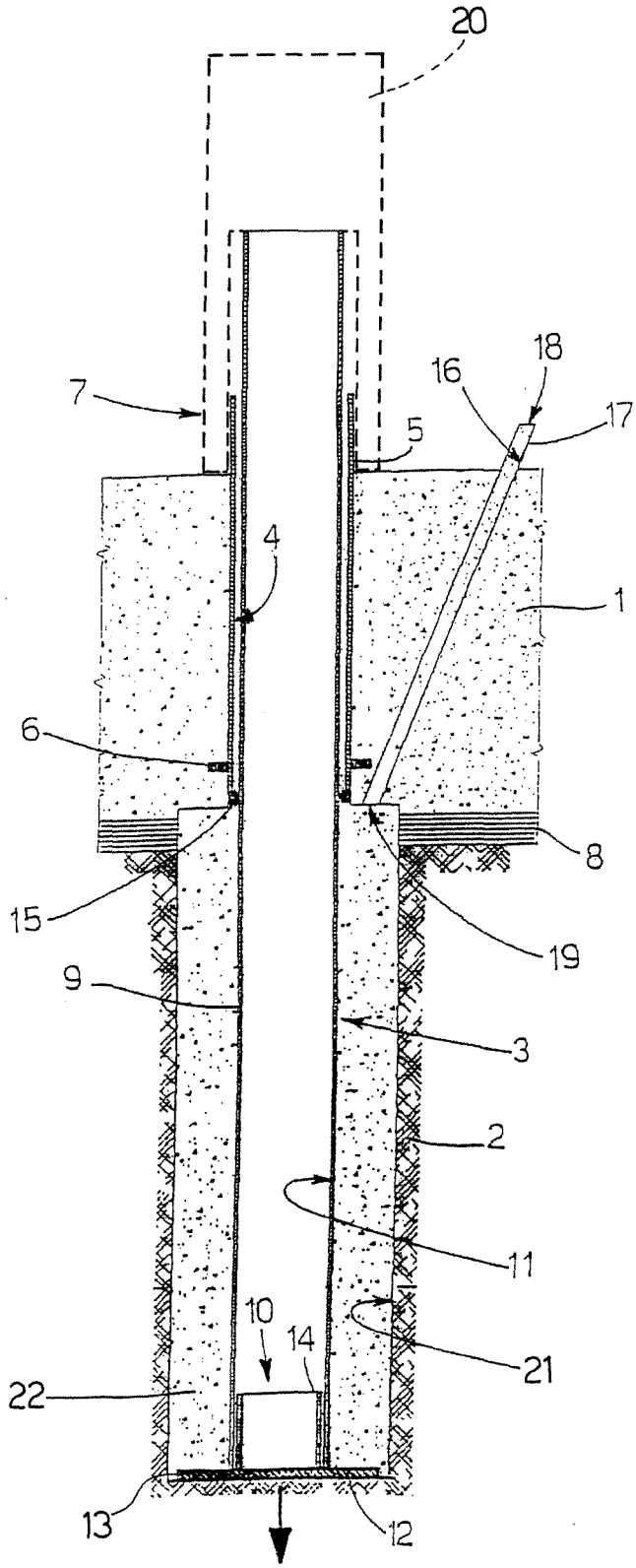
FIG. 1 shows a schematic section of a foundation pile driven into the ground using the pile driver according to the present invention.

Number 1 in FIG. 1 indicates a ground 2 foundation structure of a building (not shown). Foundation structure 1 is normally underground, and transfers the loads on it to ground 2 by means of a number of piles 3 (only one shown in FIG. 1). Each pile 3 extends downwards through foundation structure 1 and is driven into ground 2. For which purpose, foundation structure 1 has, for each pile 3, a cylindrical vertical-axis hole 4 lined with a metal guide tube 5, which is fixed to foundation structure 1 by at least one ring 6 embedded in foundation structure 1, and has a top portion 7 projecting upwards from foundation structure 1. A layer 8 of relatively so-called "lean" cement is preferably interposed between foundation structure 1 and ground 2.

Each pile 3 is a metal pile, and comprises a shaft 9 defined by a number of tubular segments butt welded to one another or connected by a cold-fitted connecting stub; and at least one wider bottom foot 10 defining the bottom end of pile 3.

Each shaft 9 is tubular, has an inner through conduit 11, and is smaller across than hole 4 so as to fit relatively easily through hole 4. Each head 10 is defined by a flat circular plate 12 with a smooth or jagged outer edge 13, is larger across than hole 4, is initially separate from shaft 9, and is placed on lean cement layer 8 (or directly on ground 2, if no lean cement layer 8 is provided), beneath foundation structure 1 and coaxially with hole 4 when building foundation structure 1. Each shaft 9 therefore engages foot 10 to form pile 3, when shaft 9 is inserted through hole 4.

To ensure firm mechanical connection of each shaft 9 and foot 10, foot 10 is provided with a connecting member 14, which engages shaft 9 to fix shaft 9 transversely to foot 10. Each connecting member 14 is normally defined by a cylindrical tubular member projecting axially from plate 12 and sized to engage a bottom portion of inner conduit 11 of shaft 9 with relatively little clearance.

A bottom end portion of each guide tube 5 is fitted with at least one sealing ring 15 made of elastic material and engaging the outer cylindrical surface of shaft 9 of pile 3 when pile 3 is inserted through hole 4.

When building foundation structure 1, at least one injection conduit 16 is formed next to each hole 4, is defined by a metal tube 17 extending through foundation structure 1, and has a top end 18 projecting from structure 1, and a bottom end 19 adjacent to hole 4 and contacting a top surface of plate 12 of relative foot 10.

To drive each pile 3 into ground 2, shaft 9 is first inserted through hole 4 to engage (as described above) foot 10, which is positioned beneath foundation structure 1, on ground 2, and coaxial with hole 4.

Once shaft 9 engages foot 10 to form pile 3, a pile driver 20 is positioned over pile 3 and secured to guide tube 5 to exert driving thrust, i.e. vertical downward thrust, on pile 3. The reaction force to the thrust exerted by pile driver 20 is provided by the weight of foundation structure 1, and is transmitted by guide tube 5, which acts as a reaction element. Alternatively, pile driver 20 may be secured to guide tube 5 before shaft 9 is inserted inside guide tube 5.

As each pile 3 is driven into ground 2, foot 10 forms in ground 2 a tubular channel 21 bounded externally by ground 2 and internally by shaft 9; and, as pile 3 is driven into ground 2, substantially plastic-state cement material 22 is simultaneously pressure-injected into tubular channel 21 along injection conduit 16. Sealing ring 15 prevents the pressure-injected cement material 22 from seeping upwards through the gap between the outer surface of shaft 9 and the inner surface of guide tube 5. Once pile 3 is driven, inner conduit 11 of pile 3 is filled with plastic-state cement material (not shown), in particular "concrete"; and, once inner conduit 11 of pile 3 is filled, pile 3 is fixed axially to foundation structure 1 by securing (normally welding) to the projecting portion 7 of guide tube 5 a metal plate (not shown) placed on top of and engaging the top end of pile 3.

Figure 2:
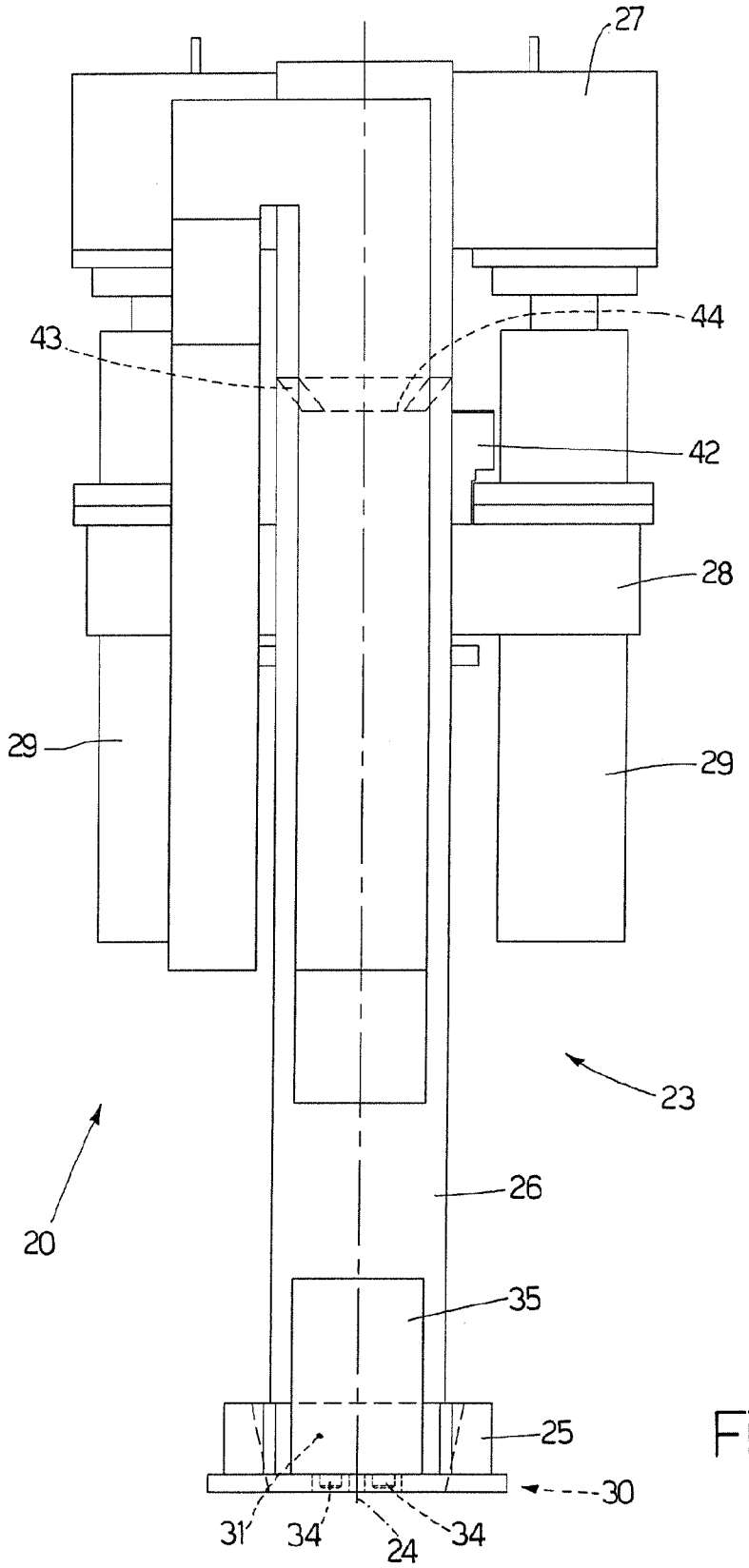
FIG. 2 shows a schematic side view of a pile driver in accordance with the present invention.
Figure 3:
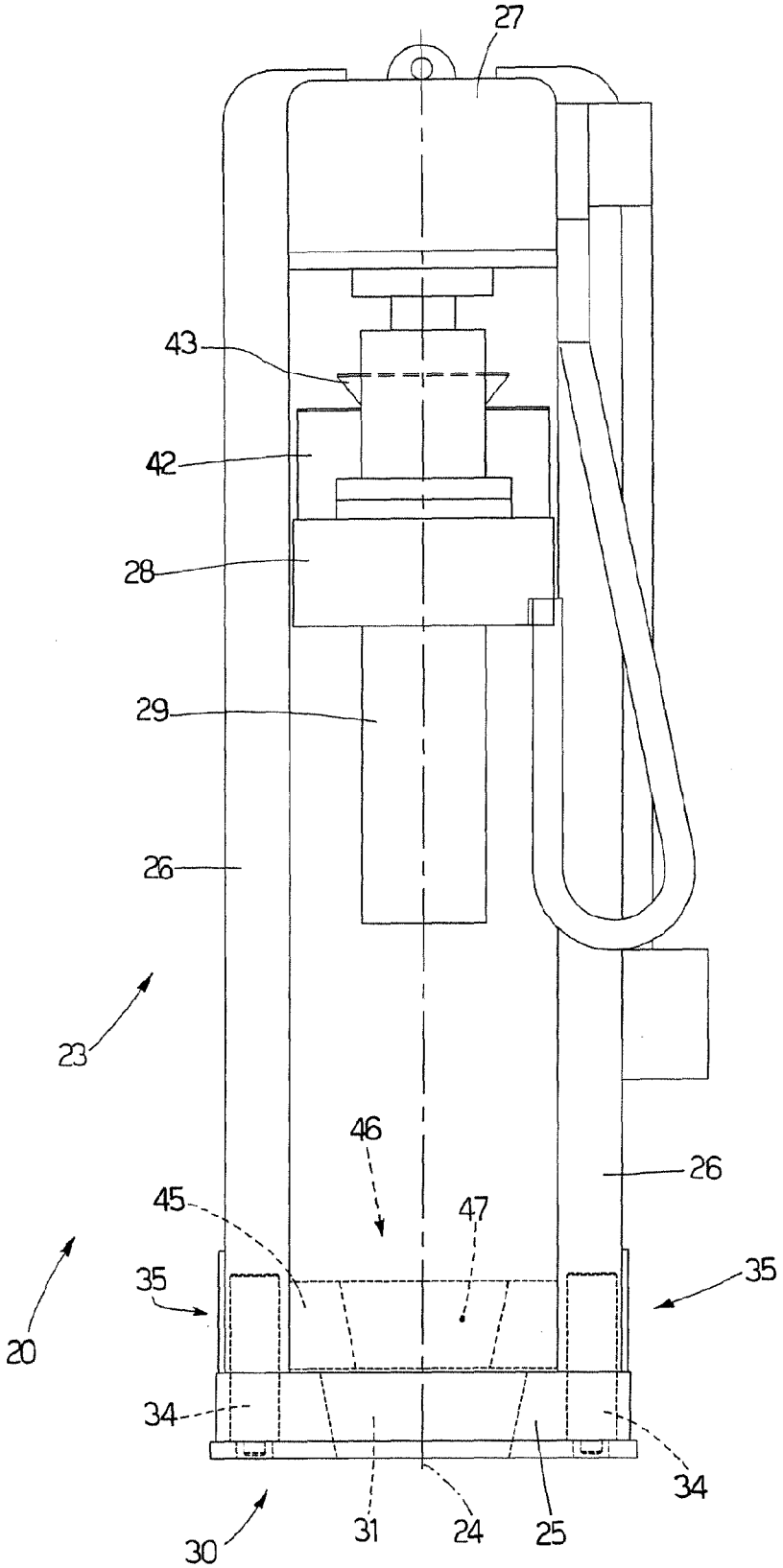
FIG. 3 shows a front view of the FIG. 2 pile driver.
Figure 4:
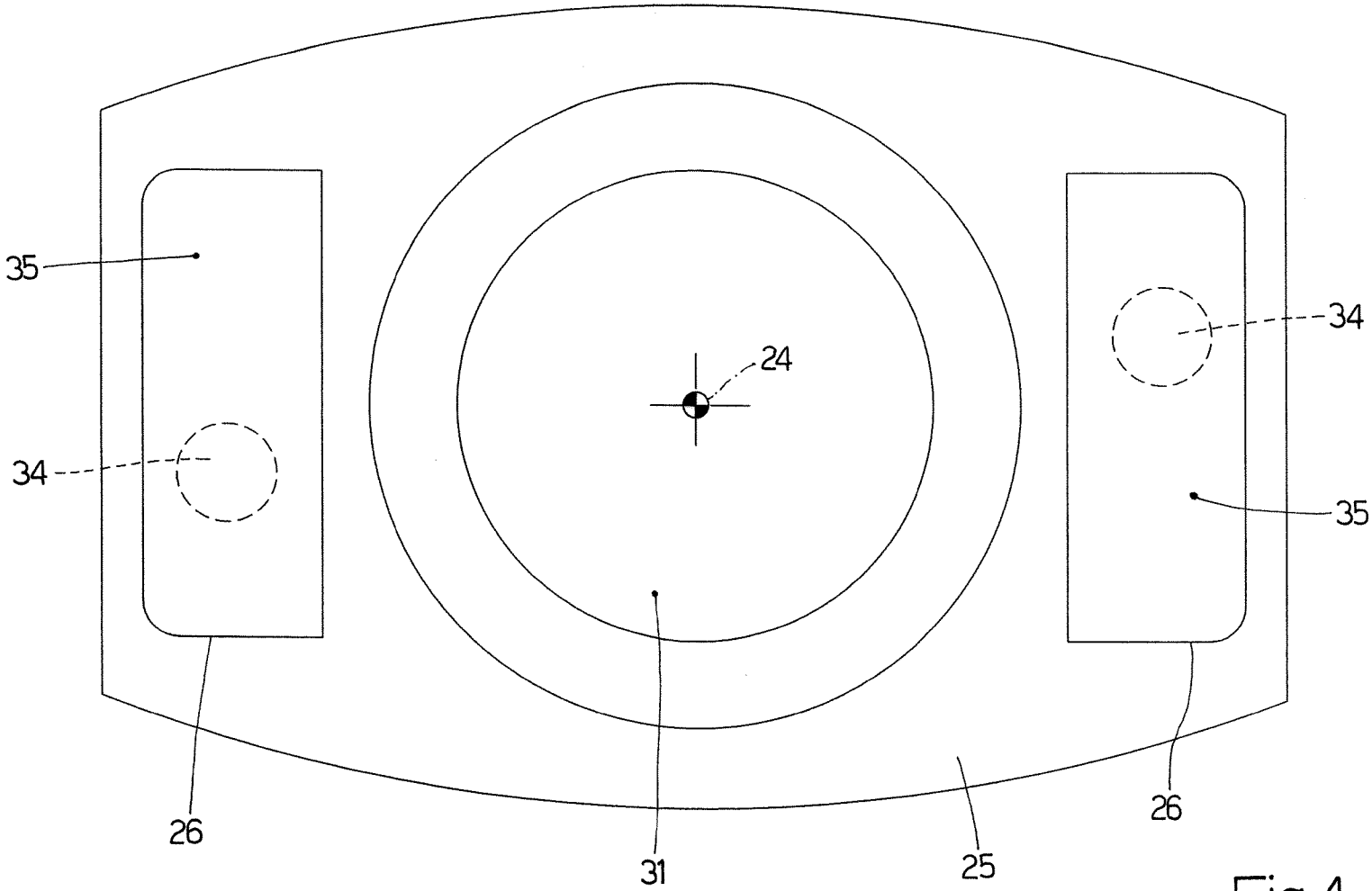
FIG. 4 shows a plan view of a horizontal supporting base of the FIG. 2 pile driver.

As shown in FIGS. 2, 3 and 4, pile driver 20 comprises a gantry-type frame 23 having a vertical axis of symmetry 24 and comprising a horizontal base 25, two uprights 26 extending upwards from base 25, and a horizontal top member 27 connecting the two uprights 26. A movable horizontal body 28 is located between the two uprights 26, and is slid along vertical axis of symmetry 24 by two hydraulic jacks 29. Each hydraulic jack 29 comprises a cylinder connected rigidly to movable body 28; and a piston fixed at the top end to a bottom surface of top member 27 of frame 23.

Figure 5:
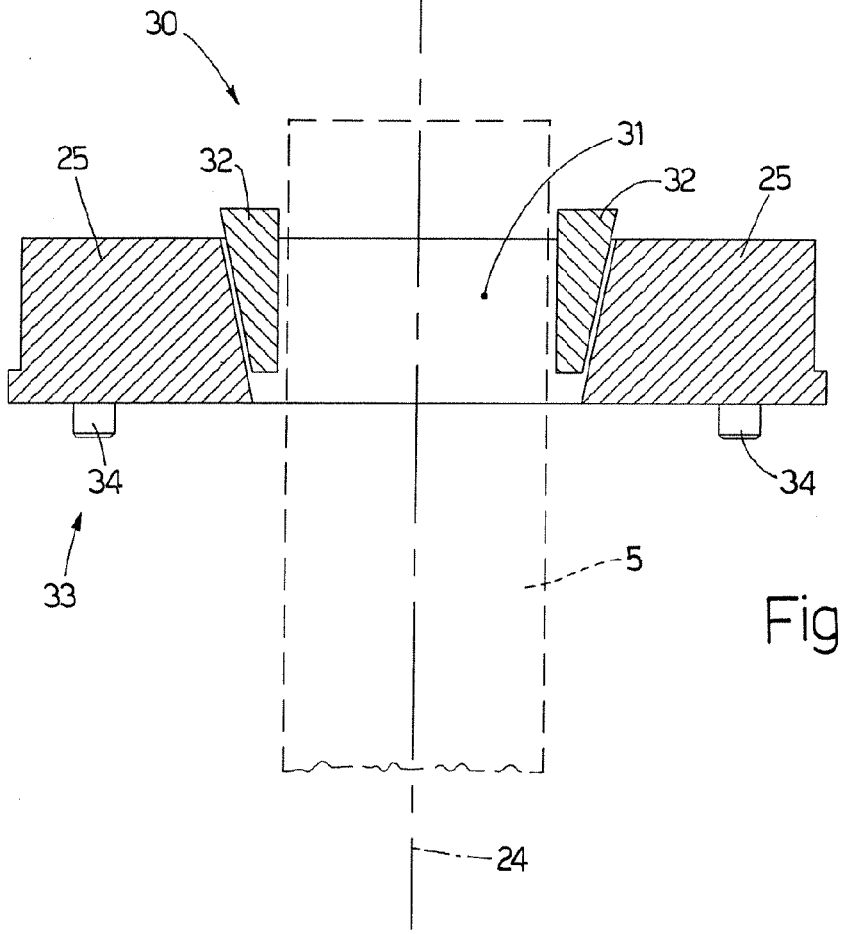
FIG. 5 shows a schematic section of a first lock device of the FIG. 2 pile driver.

Horizontal base 25 is fitted with a lock device 30, which, in use, rigidly engages a guide tube 5 of foundation structure 1. As shown in FIG. 5, lock device 30 comprises a through hole 31 formed through horizontal base 25, coaxially with vertical axis of symmetry 24, and tapering, i.e. decreasing in diameter, downwards; a number of (normally three or more) wedges 32, each of which is sector-shaped and inserted, in use, inside hole 31; and an actuating device 33 for lifting base 25 with respect to foundation structure 1 underneath.

In one possible embodiment, hole 31 is circular, and each wedge 32 is sector-shaped. In a different embodiment, hole 31 is polygonal, and each wedge 32 is in the form of a polygonal sector; the polygonal shape of hole 31 (and therefore of wedges 32) provides for also transmitting torque to guide tube 5 about vertical axis 24. In one possible embodiment, each two side by side wedges 32 substantially contact each other (i.e. wedges 32 cover almost the whole perimeter of hole 31), whereas, in a different embodiment, each two side by side wedges 32 are separated by a gap comparable in size to wedge 32 (i.e. wedges 32 cover roughly half the perimeter of hole 31).

As shown in FIGS. 3 and 4, actuating device 33 comprises two hydraulic jacks 34 supported on base 25, on opposite sides of hole 31. And a seat 35, housing at least one hydraulic jack 34, is formed in each upright 26 and closed by a hatch.

Figure 6:
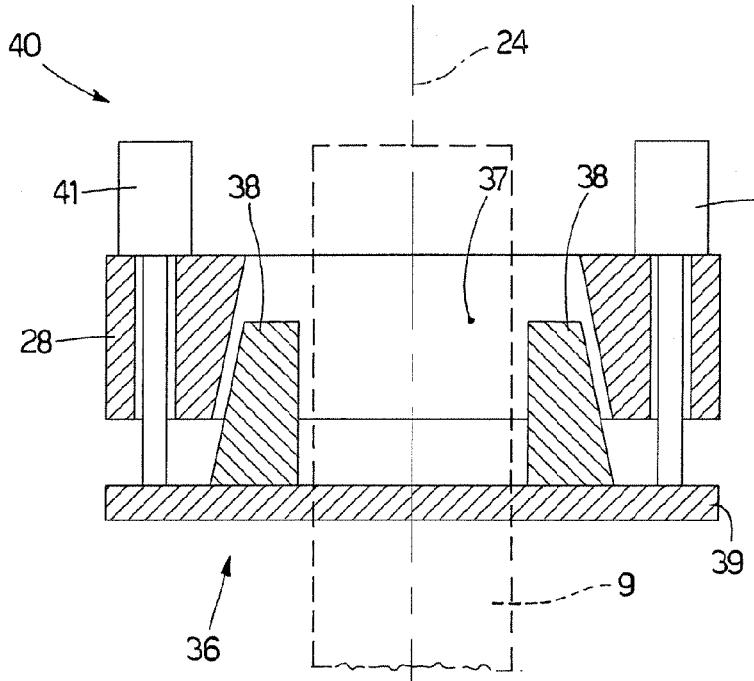
FIG. 6 shows a schematic section of a second lock device of the FIG. 2 pile driver.

As shown in FIG. 6, movable body 28 is fitted with a lock device 36, which, in use, rigidly engages shaft 9 of a pile 3 to be driven. Lock device 36 comprises a through hole 37 formed through movable body 28, coaxially with vertical axis of symmetry 24, and tapering, i.e. decreasing in diameter, upwards; a number of (normally three or more) wedges 38, each of which is sector-shaped and inserted inside hole 37; an annular supporting plate 39 located beneath movable body 28 and supporting wedges 38; and an actuating device 40 for moving supporting plate 39 towards movable body 28.

In one possible embodiment, hole 37 is circular, and each wedge 38 is sector-shaped. In a different embodiment, hole 37 is polygonal, and each wedge 38 is in the form of a polygonal sector; the polygonal shape of hole 37 (and therefore of wedges 38) provides for also transmitting torque to shaft 9 about vertical axis 24. In one possible embodiment, each two side by side wedges 38 substantially contact each other (i.e. wedges 38 cover almost the whole perimeter of hole 37), whereas, in a different embodiment, each two side by side wedges 38 are separated by a gap comparable in size to wedge 38 (i.e. wedges 38 cover roughly half the perimeter of hole 37).

Actuating device 40 comprises a number of hydraulic jacks 41 equally spaced about hole 37 and each comprising a cylinder integral with movable body 28, and a piston having an end portion integral with supporting plate 39. The piston of each hydraulic jack 41 slides inside a through hole formed through movable body 28; the cylinder of each hydraulic jack extends upwards from an annular top surface of movable body 28; and movable body 28 comprises an annular box housing 42 housing the cylinders of hydraulic jacks 41.

A centring member 43 is preferably connected rigidly to uprights 26 of frame 23, above the top limit position of movable body 28, and has a central hole 44 coaxial with vertical axis of symmetry 24 and tapering, i.e. decreasing in diameter, downwards. Centring member 43 provides for centring shaft 9 to align shaft 9 with vertical axis of symmetry 24 and therefore with hole 31 of lock device 30 and hole 37 of lock device 36.

In a further embodiment shown by the dash line, a further movable body 45 is located beneath movable body 28, is mounted to slide freely along uprights 26, and supports a lock device 46. Lock device 46 comprises a through hole 47 formed through movable body 45, coaxially with vertical axis of symmetry 24, and tapering, i.e. decreasing in diameter, downwards; and a number of wedges (not shown), each of which is sector-shaped and inserted, in use, inside hole 44.

Operation of pile driver 20 will now be described with reference to driving the FIG. 1 pile 3 into ground 2.

Firstly, pile driver 20 is set up using a crane, which lifts pile driver 20 and sets it on top of foundation structure 1, over hole 4, with base 25 resting on foundation structure 1, and top end 7 of guide tube 5 inserted inside hole 31 of lock device 30. At this point, wedges 32 are inserted inside hole 31, about top end 7 of guide tube 5, and hydraulic jacks 34 of actuating device 33 are operated to raise base 25 slightly (a few centimeters) off foundation structure 1. Raising base 25 with respect to foundation structure 1, and therefore also with respect to top end 7 of guide tube 5, compresses wedges 32 between the inner surface of hole 31 and the outer surface of guide tube 5 to achieve a firm mechanical connection between base 25 and top end 7 of guide tube 5, i.e. to lock base 25 to shaft 9.

Once base 25 is secured to guide tube 5, the first segment of shaft 9 is inserted through hole 37 in lock device 36 of movable body 28 and therefore through guide tube 5. As stated, centring member 43 aids in aligning shaft 9 with respect to vertical axis of symmetry 24 and therefore with respect to hole 37 in lock device 36.

Once the first segment of shaft 9 of pile 3 is positioned inside hole 4 and through guide tube 5, and engages foot 10 underneath, pile 3 is ready to be driven into ground 2. At this point, hydraulic jacks 41 of actuating device 40 of lock device 36 are operated to draw supporting plate 39, and therefore wedges 38 on supporting plate 39, towards movable body 28 and into hole 37, so that wedges 38 are compressed between the inner surface of hole 37 and the outer surface of shaft 9 to achieve a firm mechanical connection between movable body 28 and shaft 9, i.e. to lock movable body 28 to shaft 9.

Once lock device 36 is clamped to shaft 9, hydraulic jacks 29 are operated to push down movable body 28. The downward movement of movable body 28 produces a corresponding downward movement of shaft 9, by virtue of frame 23 being secured to foundation structure 1 by lock device 30 of base 25 being clamped about top end 7 of guide tube 5.

When hydraulic jacks 29 come to a stop, i.e. when movable body 28 reaches its bottom limit position, lock device 36 is detached from shaft 9 by operating hydraulic jacks 41 of actuating device 40 to detach supporting plate 39, and therefore wedges 38 on supporting plate 39, from movable body 28. At this point, hydraulic jacks 29 are shut off to restore movable body 28 to its top limit position, lock device 36 is clamped once more about shaft 9, and hydraulic jacks 29 are operated once more to push movable body 28 down together with shaft 9.

Once one segment of shaft 9 is driven in, another segment of shaft 9 is inserted inside pile driver 20 so that the end of the second segment contacts the end of the first, and the two ends are butt welded. It is important to note that inserting another segment of shaft 9 involves no even partial dismantling or removal of pile driver 20.

In an alternative embodiment, two successive segments of shaft 9 may be joined using a connecting stub (not shown), which partly engages and is cold-fitted inside the inner conduits of the two segments, and which may be used instead of or in addition to the butt weld. In which case, movable body 45 and relative lock device 46 may be used to steady the bottom segment of shaft 9 when cold-fitting the connecting stub. In other words, lock device 46 of movable body 45 is clamped about the bottom segment of shaft 9, and movable body 45 is rested on horizontal base 25 underneath, thus locking the bottom segment of shaft 9 to cold-fit the connecting stub.

Once foundation pile 3 is driven into ground 2, pile driver 20 is disconnected from top end 7 of guide tube 5 by releasing lock device 30, and can be repositioned to drive in another foundation pile 3. Lock device 30 is released by operating hydraulic jacks 34 of actuating device 33 to lower base 25 back onto foundation structure 1; at which point, wedges 32 can be removed easily.

Figure 7:
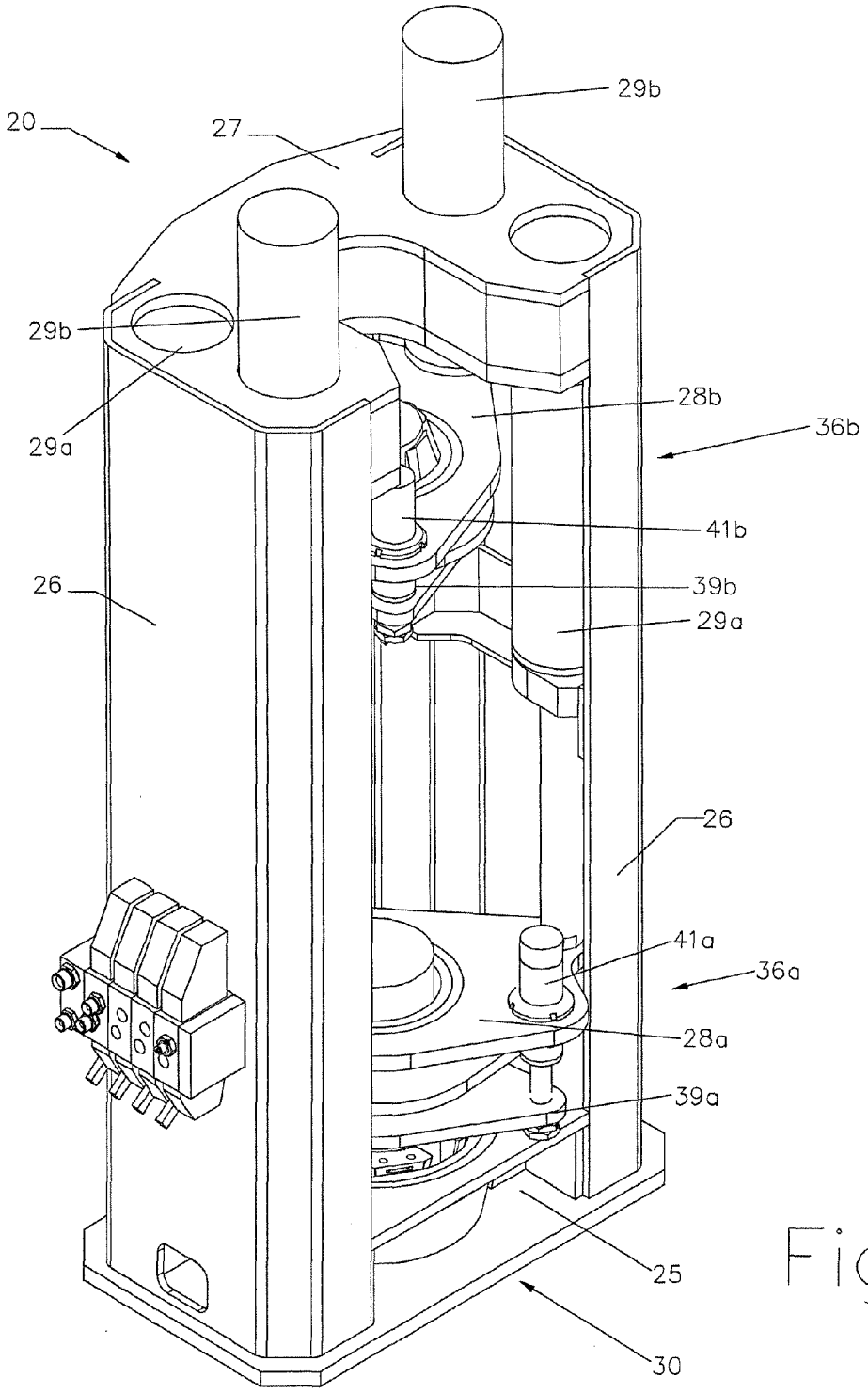
FIG. 7 shows a schematic view in perspective, with parts removed for clarity, of a variation of the FIG. 2 pile driver.
Figure 8:
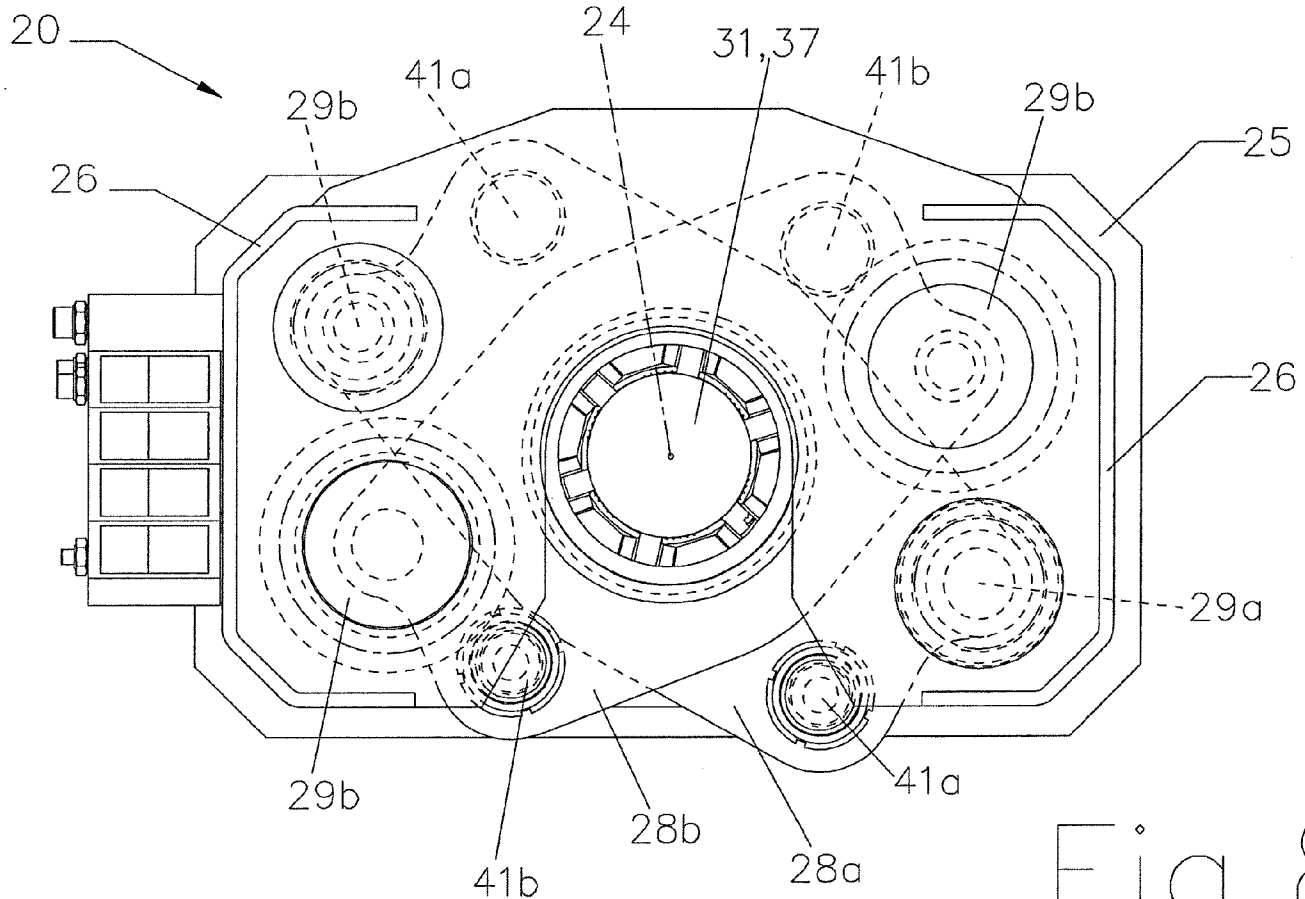
FIG. 8 shows a schematic plan view, with parts removed for clarity, of the FIG. 7 pile driver.

In the FIGS. 7 and 8 embodiment, pile driver 20 comprises at least two movable bodies 28*a* and 28*b* offset vertically with respect to each other; at least two lock devices 36*a* and 36*b*, each of which is connected to a respective movable body 28*a*, 28*b* and, in use, rigidly engages shaft 9 of pile 3 to be driven; and at least two hydraulic jacks 29*a* and 29*b*, each connected to frame 23 and to a respective movable body 28*a*, 28*b* to move movable body 28*a*, 28*b* along upright 26. Two pairs of hydraulic jacks 29*a* and 29*b* are preferably provided; and the hydraulic jacks 29*a*, 29*b* in each pair are connected to frame 23 and to a respective movable body 28*a*, 28*b* to move movable body 28*a*, 28*b* along upright 26.

In actual use, the two movable bodies 28*a* and 28*b* may be used to exert thrust simultaneously on shaft 9 of pile 3 to be driven, and so provide considerable driving force (i.e. by combining the thrust of hydraulic jacks 29*a* and 29*b*), or may be used to exert thrust alternately on shaft 9 of pile 3 to be driven, and so provide a smaller, substantially uninterrupted driving force (i.e. using the thrust of hydraulic jacks 29*a* and 29*b* alternately). The two movable bodies 28*a* and 28*b* are used to exert thrust simultaneously on shaft 9 of pile 3 to be driven, when considerable driving force is required, e.g. to penetrate a particularly hard layer of ground 2. In other situations, the two movable bodies 28*a* and 28*b* are used to exert thrust alternately on shaft 9 of pile 3 to be driven, so that, when thrust is being exerted by one pair of hydraulic jacks 29*a* or 29*b*, the other pair of hydraulic jacks 29*b* or 29*a* returns to the start position, and vice versa, thus providing a smaller, substantially uninterrupted driving force.

Figure 9:
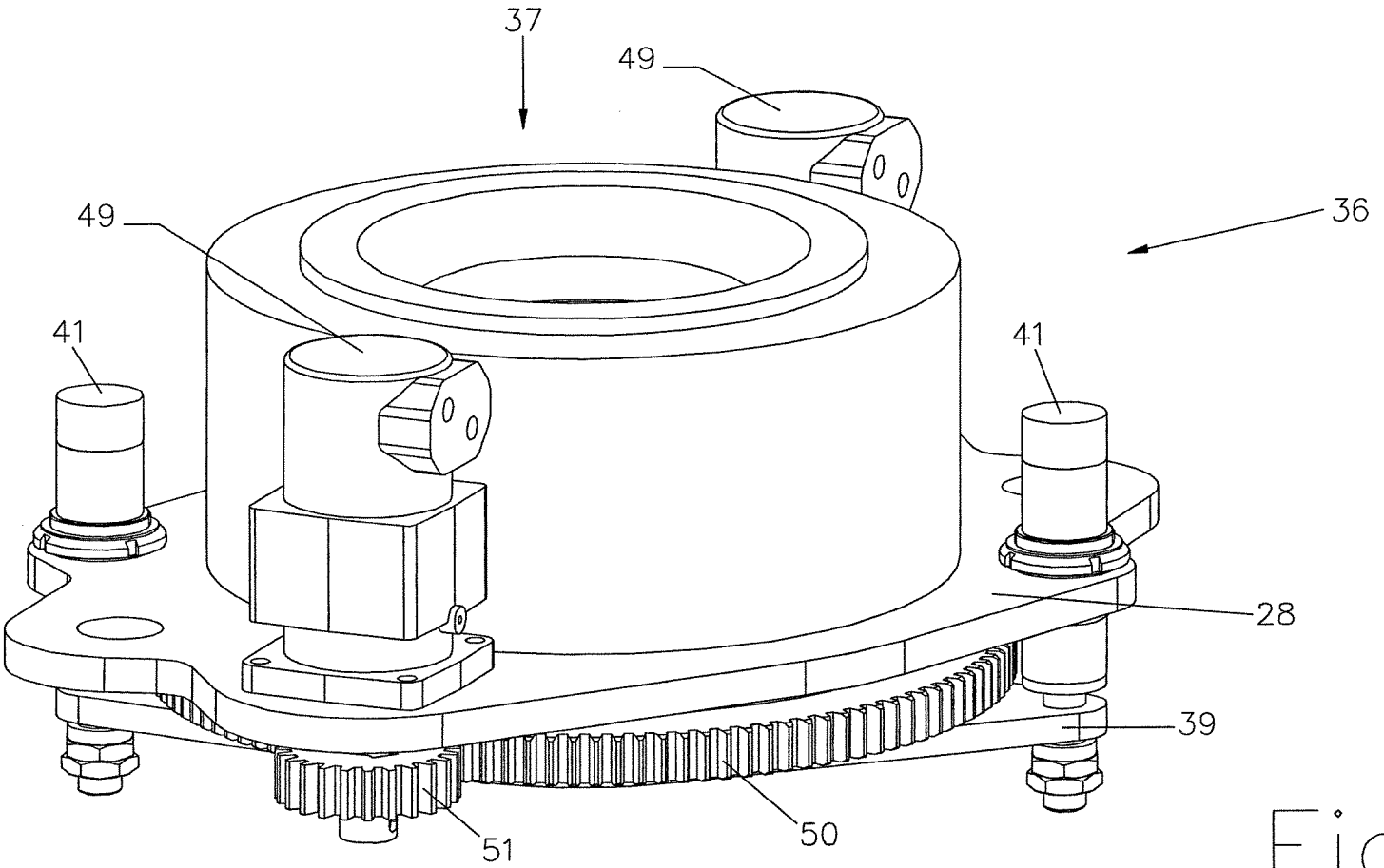
FIG. 9 shows a view in perspective of a variation of a lock device of the FIG. 2 pile driver.
Figure 10:
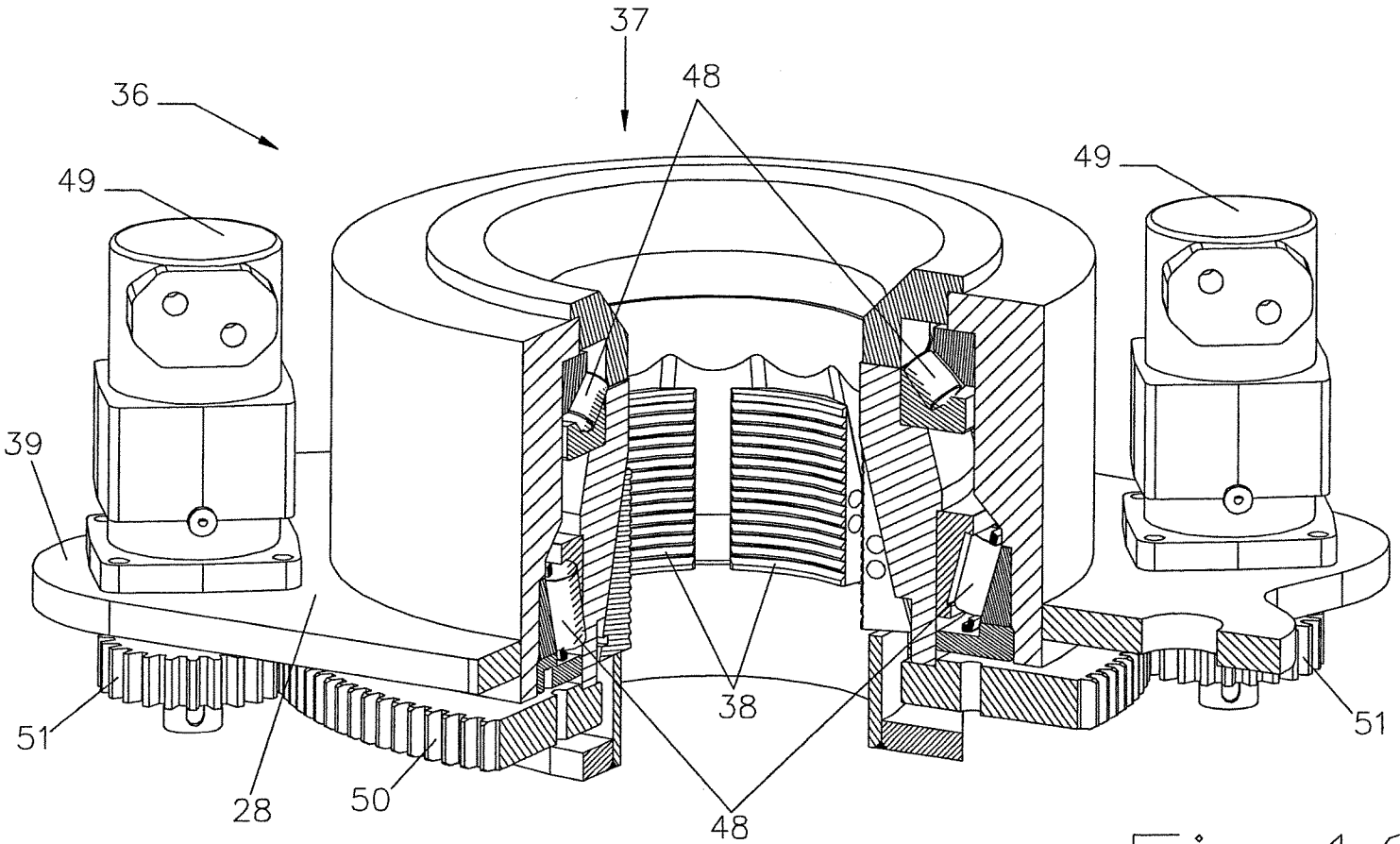
FIG. 10 shows a partly sectioned view in perspective of the FIG. 9 lock device.

In the FIGS. 9 and 10 embodiment, lock device 36 is mounted on movable body 28 to rotate with respect to movable body 28 about vertical axis 24. More specifically, lock device 36 is mounted on bearings 48 fitted to movable body 28. Moreover, movable body 28 supports a pair of motor reducers 49 (electric or hydraulic), which transmit motion to lock device 36 to rotate lock device 36 about vertical axis 24. For which purpose, lock device 36 has a ring gear 50, which meshes with two pinions 51 rotated by respective motor reducers 49, so that lock device 36 provides for rotating shaft 9 of pile 3 as pile 3 is being driven. By way of example, in actual use (i.e. when driving pile 3), lock device 36 rotates about vertical axis 24 at a speed ranging between 20 and 30 rpm.

Pile driver 20 as described above has numerous advantages: it can be set up quickly, provides for exerting considerable driving force (over 300 tons), and need not be removed to join the driven segment of shaft 9 of pile 3 to the next segment of shaft 9. Moreover, pile driver 20 as described is cheap and easy to produce and maintain. It is important to note that hydraulic jacks 34 of lock device 30 and 41 of lock device 36 are well protected against dirt and shock, and so need less maintenance and repair.

Pile driver 20 as described above is preferably used to drive foundation piles 3 of the type shown in FIG. 1, but may also be used to advantage for driving other types of foundation piles differing from the FIG. 1 pile 3 as regards the way in which the pile is secured to the foundation structure. In which case, lock device 30 must be modified to adapt it accordingly.

The invention claimed is:

1. A pile driver for driving foundation piles, comprising:

a gantry-type frame, in turn comprising a horizontal base resting on an underlying foundation structure, two uprights extending upwards from the base, and a horizontal top member connecting the two uprights;

a first movable body which is located between the two uprights and slides along the uprights;

a first lock device fitted to the base and which, in use, rigidly engages a connecting member of the underlying foundation structure;

a second lock device fitted to the first movable body and which, in use, rigidly engages a shaft of a pile to be driven; and at least one first hydraulic jack to move the first movable body along the uprights, the first hydraulic jack comprises a cylinder connected rigidly to the first movable body and a piston fixed at the top end to a bottom surface of the top member of the frame;

wherein the first lock device comprises a through first hole formed through the base and tapering downwards; a number of first wedges, each of which is sector shaped and inserted, in use, inside the first hole; and a first actuating device for raising the base of the frame with respect to the underlying foundation structure; and wherein the second lock device comprises: a through second hole formed through the first movable body and tapering upwards; a number of second wedges, each of which is sector-shaped and inserted inside the second hole; an annular supporting plate located beneath the first movable body and supporting the second wedges; and a second actuating device supporting plate towards for moving the first movable the body.

2. The pile driver as claimed in claim 1, wherein the first actuating device comprises at least two second hydraulic jacks supported on the base and located about the first hole.

3. The pile driver as claimed in claim 2, wherein a seat, housing the respective second hydraulic jack, is formed in each upright.

4. The pile driver as claimed in claim 1, wherein the second actuating device comprises a plurality of third hydraulic jacks equally spaced about the second hole, and each of which comprises a cylinder integral with the first movable body, and a piston having an end portion integral with the supporting plate.

5. The pile driver as claimed in claim 4, wherein the cylinder of each third hydraulic jack extends upwards from an annular top surface of the first movable body.

6. The pile driver as claimed in claim 4, wherein the first movable body comprises an annular box housing, housing the cylinders of the third hydraulic jacks.

7. The pile driver as claimed in claim 1 and comprising a centering member, which is connected rigidly to the upright of the frame, above a top limit position of the first movable body, and comprises a central third hole tapering downwards.

8. The pile driver as claimed in claim 1, and comprising a second movable body located beneath the first movable body and supporting a third lock device.

9. The pile driver as claimed in claim 8, wherein the third lock device comprises: a through fourth hole formed through the second movable body and tapering downwards; and a number of third wedges, each of which is sector-shaped and inserted, in use, inside the fourth hole.

10. The pile driver as claimed in claim 8, wherein the second movable body is mounted to slide freely along the upright.

11. The pile driver as claimed in claim 1, wherein the second lock device is mounted on the first movable body to rotate with respect to the first movable body about a vertical axis.

12. The pile driver as claimed in claim 11, wherein the first movable body supports at least one motor reducer, which transmits motion to the second lock device to rotate the second lock device about the vertical axis; the second lock device has a ring gear, which meshes with a pinion rotated by the motor reducer.

13. The pile driver as claimed in claim 1, and comprising:

at least two first movable bodies offset vertically with respect to each other;

at least two second lock devices, each of which is connected to a respective first movable body and, in use, rigidly engages the shaft of the pile to be driven; and at least two first hydraulic jacks, each of which is connected to the frame and to a respective first movable body to move the first movable body along the upright;

wherein the two first movable bodies and the two first hydraulic jacks are usable to exert thrust simultaneously on the shaft of the pile to be driven, so as to provide for considerable driving force; or the two first movable bodies and the two first hydraulic jacks are usable to exert thrust alternately on the shaft of the pile to be driven, so as to provide for a smaller, substantially uninterrupted driving force.

14. The pile driver as claimed in claim 13, and comprising two pairs of first hydraulic jacks; and the hydraulic jacks in each pair are connected to the frame and to a respective first movable body to move the first movable body along the upright.

15. A pile driver for driving foundation piles, comprising:

a gantry-type frame, in turn comprising a horizontal base resting on an underlying foundation structure, two uprights extending upwards from the base, and a horizontal top member connecting the two uprights;

a first movable body which is located between the two uprights and slides along the uprights;

a first lock device fitted to the base and which, in use, rigidly engages a connecting member of the underlying foundation structure;

a second lock device fitted to the first movable body and which, in use, rigidly engages a shaft of a pile to be driven;

at least one first hydraulic jack to move the first movable body along the uprights, the first hydraulic jack comprises a cylinder connected rigidly to the first movable body and a piston fixed at the top end to a bottom surface of the top member of the frame;

a second movable body, which is located beneath the first movable body, is not connected to any actuator to be mounted to slide freely along the upright, and is normally rested on the horizontal base of the frame;

a third lock device fitted to the second movable body and which, in use, rigidly engages the shaft of the pile;

wherein the first lock device comprises a through first hole formed through the base and tapering downwards; a number of first wedges, each of which is sector shaped and inserted, in use, inside the first hole; and a first actuating device for raising the base of the frame with respect to the underlying foundation structure;

wherein the second lock device comprises: a through second hole formed through the first movable body and tapering upwards; a number of second wedges, each of which is sector-shaped and inserted inside the second hole; an annular supporting plate located beneath the first movable body and supporting the second wedges; and a second actuating device supporting plate towards for moving the first movable the body; and wherein, to join two successive segments the shaft of the pile, the second movable body and relative third lock device are used to steady the bottom segment of the shaft by the third lock device being clamped about the bottom segment of the shaft and the second movable body being rested on the horizontal base underneath.

* * * * *